US008919357B2

(12) United States Patent
Breit

(10) Patent No.: US 8,919,357 B2
(45) Date of Patent: Dec. 30, 2014

(54) STEAM APPLIANCE

(71) Applicant: Euro-Pro Operating LLC, Newton, MA (US)

(72) Inventor: Oliver Rudolph Breit, Mid Levels (HK)

(73) Assignee: Euro-Pro Operating LLC, Newton, MA (US)

( * ) Notice: Subject to any disclaimer, the term of this patent is extended or adjusted under 35 U.S.C. 154(b) by 0 days.

(21) Appl. No.: 13/653,717

(22) Filed: Oct. 17, 2012

(65) Prior Publication Data

US 2013/0160803 A1 Jun. 27, 2013

Related U.S. Application Data

(63) Continuation of application No. 12/567,718, filed on Sep. 25, 2009, now abandoned.

(51) Int. Cl.
*B08B 3/00* (2006.01)
*A47L 11/40* (2006.01)

(52) U.S. Cl.
CPC ..... *B08B 3/00* (2013.01); *B08B 2230/01* (2013.01); *A47L 11/4086* (2013.01)
USPC ..... 134/105

(58) Field of Classification Search
CPC ..... B08B 2230/01
See application file for complete search history.

(56) References Cited

U.S. PATENT DOCUMENTS

| | | | | |
|---|---|---|---|---|
| 3,000,036 | A * | 9/1961 | De Benedetti | 15/314 |
| 5,609,047 | A | 3/1997 | Hellman, Jr. et al. | |
| 6,295,691 | B1 | 10/2001 | Chen | |
| 7,237,409 | B2 | 7/2007 | Lin | |
| 7,475,448 | B2 | 1/2009 | Rosenzweig et al. | |
| 7,516,565 | B1 | 4/2009 | Tsen | |
| 2003/0145880 | A1 | 8/2003 | Jepsen et al. | |
| 2005/0125934 | A1 | 6/2005 | Reese | |
| 2005/0161538 | A1 | 7/2005 | Cattaneo et al. | |
| 2005/0274403 | A1 | 12/2005 | Lin | |
| 2006/0000049 | A1 | 1/2006 | Rosenzweig et al. | |
| 2011/0073135 | A1 | 3/2011 | Breit | |

FOREIGN PATENT DOCUMENTS

| | | | |
|---|---|---|---|
| CN | 2389017 Y | | 7/2000 |
| CN | 2544162 Y | | 4/2003 |
| CN | 2544162 Y | * | 4/2003 |
| CN | 2568904 Y | | 8/2003 |
| CN | 2577987 Y | | 10/2003 |
| CN | 2577987 Y | * | 10/2003 |
| CN | 1500565 A | | 6/2004 |
| CN | 2639658 Y | | 9/2004 |
| CN | 2644027 Y | | 9/2004 |

(Continued)

OTHER PUBLICATIONS

Evaluation Report for Chinese Application No. 201020138464.6.

(Continued)

*Primary Examiner* — Jason Ko
(74) *Attorney, Agent, or Firm* — Wolf, Greenfield & Sacks, P.C.

(57) ABSTRACT

A steam appliance includes a steam applicator which is connectable to the steam appliance, but the steam applicator is permitted to rotate without loosening or disengaging the connection of the steam applicator to the steam appliance. Embodiments may be particularly suitable for use with a portable, handheld steam appliance that employs steam pocket technology.

19 Claims, 3 Drawing Sheets

(56) References Cited

FOREIGN PATENT DOCUMENTS

| | | | |
|---|---|---|---|
| CN | 2689033 | Y | 3/2005 |
| CN | 2741495 | Y | 11/2005 |
| CN | 101022898 | A | 8/2007 |
| CN | 1439836 | A | 9/2009 |
| DE | 2004014412 | U1 | 11/2004 |
| EP | 0 719 516 | A2 | 7/1996 |
| EP | 1 223 844 | A1 | 7/2002 |
| JP | 58-156587 | U | 10/1983 |
| JP | 09-154569 | A | 6/1997 |
| JP | 2001-327449 | A | 11/2001 |
| JP | 2003-526489 | A | 9/2003 |
| KR | 20070016449 | A | 2/2007 |
| KR | 10-2007-0119256 | A | 12/2007 |
| WO | WO 01/21054 | A1 | 3/2001 |
| WO | WO 2006/014311 | A1 | 2/2006 |
| WO | WO 2008/012661 | A2 | 1/2008 |

OTHER PUBLICATIONS

Novelty Evaluation Report for Chinese Application No. 201020138464.6.

Chinese Office Action for CN 201010127191.0 mailed Aug. 2, 2012.

Report of Utility Model Technical Opinion for JP 2010-001169 mailed Jun. 15, 2011.

International Search Report and Written Opinion for PCT/US2010/048043 mailed May 26, 2011.

International Preliminary Report on Patentability for PCT/US2010/048043 mailed Apr. 5, 2012.

* cited by examiner

STEAM APPLIANCE

CROSS-REFERENCE TO RELATED APPLICATIONS

This application is a continuation of U.S. application Ser. No. 12/567,718, entitled "Steam Appliance", filed Sep. 25, 2009, which is herein incorporated by reference in its entirety.

FIELD OF THE INVENTION

The invention relates generally to steam appliances, and more specifically to a steam applicator that is connectable to a conduit but constructed and arranged be rotated without loosening or disengaging the connection.

DISCUSSION OF THE RELATED ART

Steam appliances are used in the home to apply steam to floors for cleaning and sanitizing. Various types of steam appliances are known, including canister steam appliances and self-contained steam mops for example. Canister steam appliances typically include a rollable steam generation unit, a hose to transfer the steam from the steam generation unit, a pole, and a mop head or other accessory which is connected to the end of the pole. Self-contained steam mops include a steam generation unit mounted directly on the pole. Handheld steam appliances typically include a container and a nozzle for discharging steam directly from the mouth of the container.

SUMMARY

Embodiments of the invention provided herein are directed to steam appliances in which a steam applicator is connectable to the steam appliance, but the steam applicator is permitted to rotate without loosening or disengaging the connection of the steam applicator to the steam appliance.

According to one embodiment of the invention, a steam appliance includes a steam generation unit, a steam applicator, and a steam conduit configured to guide steam from the steam generation unit to a steam inlet for the steam applicator. The steam applicator is connectable to the steam conduit, and the steam applicator is rotatable relative to the steam conduit in either rotational direction without loosening the connection of the steam applicator to the steam conduit.

According to another embodiment of the invention, a method of using a steam applicator having a handle with a end-to-end direction includes acts of grasping the handle with a first hand, grasping a steam conduit with a second hand, bringing a first threaded portion of the steam applicator into contact with a second threaded portion of the steam conduit, and connecting the steam applicator to the steam conduit. The method further includes using the steam applicator to apply steam to an object, and rotating the handle in either rotational direction about the end-to-end direction of the handle to rotate the steam applicator, wherein the rotation of the handle does not loosen the connection of the steam applicator to the steam conduit. Also included is a method of disconnecting the steam applicator from the steam conduit by simultaneously rotating the first threaded portion relative to the second threaded portion and applying an axial force between the conduit and the steam applicator, the axial force being sufficient to overcome a force applied by a resilient element, such that at least one of the first and second threaded portions is altered from a configuration in which the at least one threaded portion is rotatable relative to whichever of the steam applicator and the steam conduit that it is positioned on, to a configuration in which the at least one threaded portion is not rotatable relative to whichever of the steam applicator and the steam conduit that it is positioned on.

According to a further embodiment of the invention, a steam appliance includes a steam generation unit, a steam applicator having a handle, a steam conduit to guide steam from the steam generation unit to the steam applicator, and means for mechanically connecting the steam conduit to the handle of the steam applicator. The handle is permitted to repeatedly rotate relative to the steam conduit in either rotation direction about an end-to-end direction of the handle without loosening the connection of the handle to the steam conduit.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF THE DRAWINGS

The accompanying drawings are not intended to be drawn to scale. For purposes of clarity, not every component may be labeled in every drawing. In the drawings.

DETAILED DESCRIPTION

Applicants have recognized the importance of providing a steam applicator assembly which can be freely rotated without compromising the connection of the applicator assembly to a steam conduit. The ability to rotate the steam applicator can be particularly important when the steam applicator assembly is a handheld assembly that is attached to a flexible hose or other flexible conduit because a user may wish to rotate the steam applicator without twisting or kinking the hose. It is also desirable to prevent unintentional disengagement of the steam applicator during rotation of the steam applicator to avoid steam loss and the inconvenience of reconnecting the steam applicator.

According to some embodiments of the invention, a steam appliance permits a user to engage and disengage the steam applicator with the same type of motion and without detaching any components. In some embodiments, disconnecting the steam applicator requires two distinct motions. For example, a user may need to push the steam applicator toward the steam conduit and then twist the conduit to separate the steam conduit and the steam applicator.

According to one embodiment of the invention, a steam applicator is connected to a flexible steam conduit with a threaded connector configuration which allows rotation of the steam applicator relative to the steam conduit during use without compromising the connection. The threaded connector includes an external thread portion and an internal thread portion. One of the thread portions, for example the internal thread portion, is positioned within an element such as a handle on the steam applicator. The internal thread portion is constructed and arranged to rotate within the handle. By allowing the internal thread portion to "float" within the handle, friction between the thread portions rotates the internal thread portion within the handle, thereby substantially preventing the complementary external thread portion from being fully twisted into or out of the internal thread portion. To successfully twist the external thread portion into or out of the internal thread portion, the user pushes the two thread portions toward each other, which temporarily fixes the internal thread portion to the handle, thereby permitting relative rotation of the two thread portions.

Figure 1:
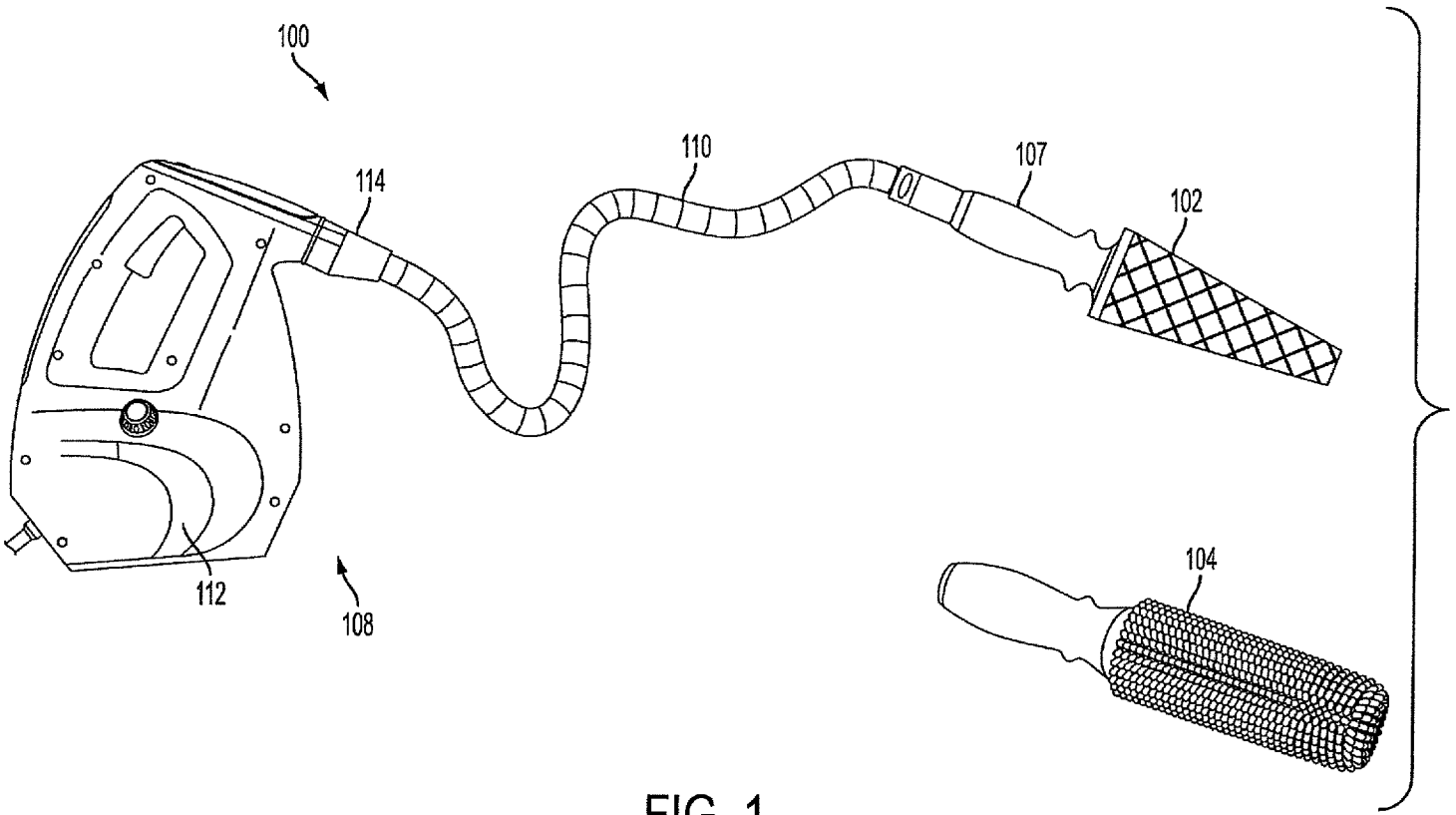
FIG. 1 is a side view of a steam appliance system according to one embodiment of the invention.

A steam appliance system 100 including two attachable steam applicators 102, 104 is shown in FIG. 1. Steam applicators 102, 104 each may include a handle 107 which is permanently or detachably attached to the applicator. In the embodiment of FIG. 1, steam appliance system 100 includes a steam generation unit 108, a steam conduit 110, and attached steam applicator 102. Steam generation unit 108 may include any suitable type of steam generation system, for example a cool water reservoir 112 and an aluminum die-cast steam generator (not shown). In some embodiments, water may be heated to its boiling point within its reservoir to create steam. It should be noted that the method of steam generation is not intended to be a limiting aspect of the invention.

In some embodiments, the steam generation unit 108 is handheld, while in other embodiments the steam generation unit may include a shoulder strap, or include wheels or other rollers.

Steam conduit 110 is a flexible hose in some embodiments. Steam conduit 110 may be attachable to steam generation unit 108 with any suitable attachment 114, including a removable connector, such as a bayonet connector.

Figure 2:
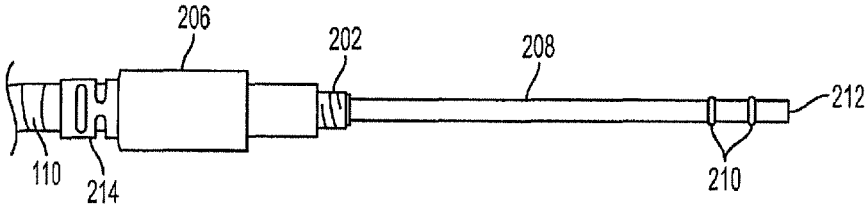
FIG. 2 is a side view of a first portion of a connector according to one embodiment of the invention.
Figure 3:
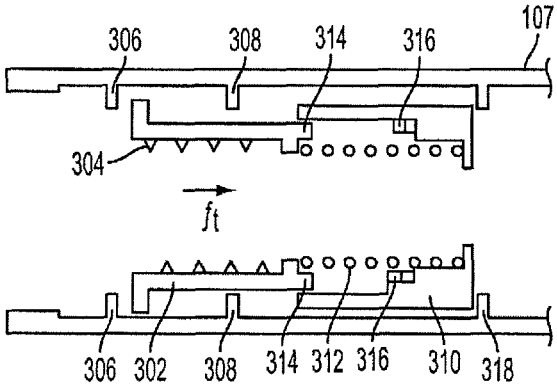
FIG. 3 is a cross-sectional view of a second portion of a connector configured to engage with the first portion illustrated in FIG. 2.
Figure 4:
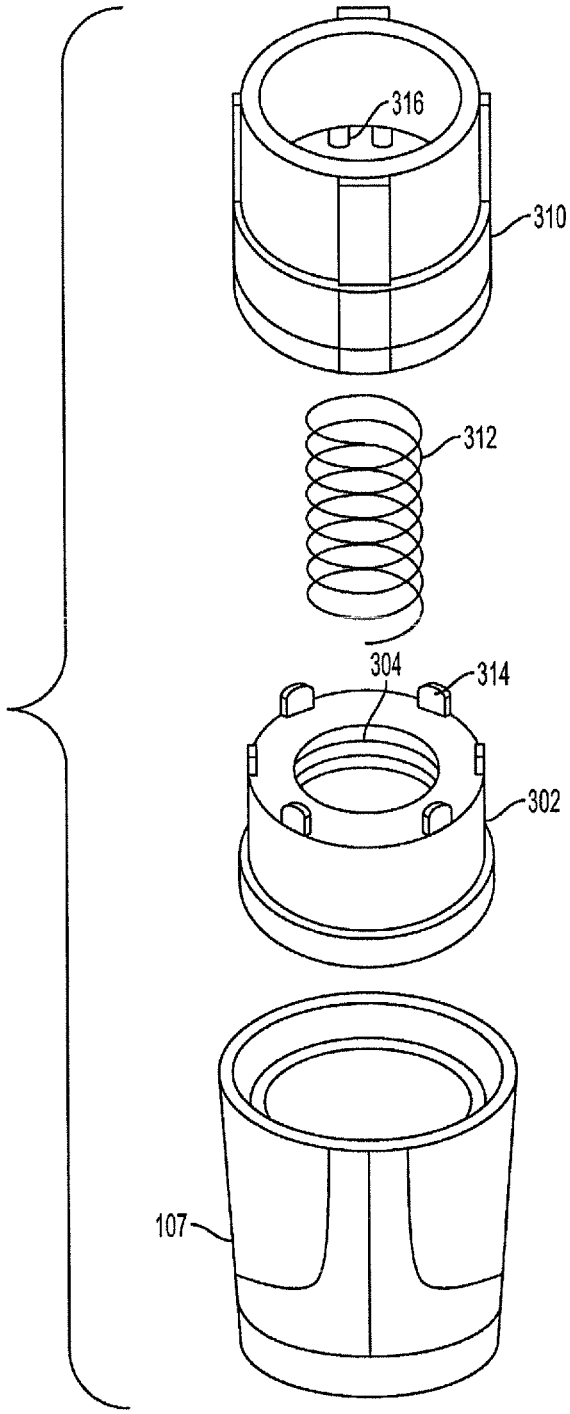
FIG. 4 is an exploded perspective view of components of the second connector portion illustrated in FIG. 3.

One particular embodiment of a steam appliance which permits rotation a steam applicator without compromising the connection of the steam applicator to the steam appliance is shown in FIGS. 2-4. In this embodiment, a steam appliance includes an externally-threaded connector portion 202 attached to steam conduit 110. A hand grasp portion 206 is attached to steam conduit 110 and threaded connector portion 202 for the user to grip when attaching or detaching steam conduit 110 and handle 107.

Steam conduit includes an elongated stem 208 to guide steam through handle 107 and to a steam outlet 212. O-rings 210 or other seal elements may be positioned on stem 208 to establish a seal with the steam applicator, whether that seal be within the handle of the steam applicator, or within the steam applicator itself. The stem and sealing aspects of the illustrated embodiment are not intended to be limiting. A stress release sleeve 214 may be included at the junction of steam conduit 110 and hand grasp portion 206 in some embodiments.

An internally-threaded connector portion 302 with threads 304 is positioned within handle 107 in the embodiment illustrated in FIG. 3. Connector portion 302 is permitted to rotate within handle 107, and is also permitted to move axially between stops 306 and 308. Connector portion 302 is biased away from a lock element 310 by a coil spring 312. Instead of a spring, any suitable resilient element may be used to bias connector portion 302 away from lock element 310. For example, a compressible resilient foam gasket may be used in some embodiments. In still other embodiments, a constant force spring, an elastic band, or any other suitable tensioning device, may bias connector portion 302 away from locking element 310 by pulling on connector portion 302.

When a user initially inserts externally-threaded connector portion 202 into internally-threaded connector portion 302, rotating the two portions relative to each other will not result in a mating of the threaded portions because connector portion 302 rotates with connector portion 202. However, when the user pushes connector portion 302 against locking element 310 by providing an axial force of at least a threshold force $f_t$ to overcome the force provided by coil spring 312 connector portion is prevented from rotating by more than a small angle because locking tabs 314 on connector portion 302 are rotated into abutment with locking tabs 316 on the locking element 310. With locking element 310 prevented from rotating, connector portion 202 can be twisted into mating engagement with connector portion 302. Locking element 310 is prevented from moving axially away from connector portion 302 by a stop 318.

In this manner, two distinct motions are required of the user to attach or remove a steam applicator from steam conduit 110. While in the illustrated embodiment the two distinct motions include an axial force and a twisting force acting simultaneously, other multiple distinct action configurations may be used. For example, in some embodiments, a ball and groove quick disconnect coupling is used to connect a steam conduit to a steam applicator. In such an embodiment, a first motion may include moving a locking collar, and a second motion may include pulling the handle of the steam applicator away from the steam conduit. Some embodiments may require two or more distinct motions to remove a steam applicator, while allowing attachment of a steam applicator with only a single motion.

By requiring two or more distinct motions to remove a steam applicator, unintended disengagement or loosening of the steam applicator during use of the steam appliance may be prevented. For example, the user may rotate the steam applicator in either direction about an end-to-end direction of the steam application when cleaning surfaces, and it may be beneficial to avoid having the steam conduit rotate as a result of the steam applicator rotations. By allowing connector portion 302 to rotate relative to handle 107, handle 107 can rotate without twisting steam conduit 110 and with loosening the engagement of the two threaded connectors. For purposes herein, loosening a connection is intended to include compromising a connection. For example, in some embodiments, a connection may become less than fully engaged such that the connection is at risk of disengaging, yet the connection may not permit perceptible movement of the two connected components relative to one another.

In some embodiments, one or more rotation stops may be included to limit the rotation angle of the steam applicator in either rotation direction (e.g., clockwise and counterclockwise about an end-to-end direction of the steam applicator). In such an embodiment, the steam applicator is permitted to rotate a certain amount, for example by permitting connector portion 302 to rotate, but the steam applicator rotation is prevented from further rotations by the rotation stops. The rotation stops may include one or more tabs (not shown) protruding from an interior wall of handle 107 between stops 306 and 308. In some embodiments, the steam applicator is permitted to rotate 180 degrees in either direction, and in some embodiments, the steam applicator is permitted to rotate 360 degrees in either direction.

The embodiments described above allow for a tool-free attachment and removal of steam applicators from the steam appliance. In some embodiments, however, a tool may be used.

While embodiments described herein are directed to rotations of a steam applicator or a handle about an end-to-end direction of the steam application or the handle, in some embodiments, pitch and/or yaw rotations may be permitted as well. A universal joint may be used in addition to, or instead of, the structures described herein.

For purposes herein, the terms "connect", "connected", "connection", "attach", "attached" and "attachment" refer to direct connections and attachments, indirect connections and attachments, and operative connections and attachments. For example, steam applicator 102 is considered to be connected to steam conduit 110 even though steam applicator is directly connected to handle 107 which is, in turn, connected to steam conduit 110. Also for purposes herein, the terms "connectable", "attachable", "removable", etc. refer both to components which can be connected, attached, removed, etc., and also refer to components which are connected, attached and removed.

For ease of understanding, and without limiting the scope of the invention, the embodiments to which this disclosure is addressed are described above particularly in connection with a handheld portable steam appliance. It should be appreciated, however, that the present invention can be embodied in other types of steam appliances. Additionally, while the steam applicators described above employ steam pocket technology, other types of steam applicators may be used in conjunction with embodiments disclosed herein.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

The invention claimed is:

1. A steam cleaning appliance, comprising:

a steam generation unit;

a steam cleaning applicator; and a flexible steam conduit configured to guide steam from the steam generation unit to a steam inlet for the steam cleaning applicator;

wherein the steam cleaning applicator is connectable to the steam conduit;

the steam cleaning applicator is rotatable relative to the steam conduit in either rotational direction without loosening the connection of the steam applicator to the steam conduit;

the steam cleaning applicator has an end-to-end direction and the steam cleaning applicator is rotatable by at least 360 degrees relative to the steam conduit in either rotational direction about the end-to-end direction of the steam cleaning applicator, without loosening the connection of the steam cleaning applicator to the steam conduit.

2. A steam cleaning appliance as in claim 1, wherein the steam applicator is connectable to the steam conduit via a handle.

3. A steam cleaning appliance as in claim 2, wherein the handle has an end-to-end direction, and the handle is rotatable relative to the steam conduit about the end-to-end direction of the handle in either rotational direction without loosening the connection of the steam cleaning applicator to the steam conduit.

4. A steam cleaning appliance as in claim 1, wherein the steam cleaning applicator is repeatedly rotatable relative to the steam conduit in either rotational direction about an end-to-end direction of the steam cleaning applicator without loosening the connection of the steam cleaning applicator to the steam conduit.

5. A steam cleaning appliance as in claim 1, wherein the steam cleaning applicator is connectable to the steam conduit with a tool-free connection.

6. A steam cleaning appliance as in claim 5, wherein at least two distinct user actions are required to remove the steam cleaning applicator from the steam conduit.

7. A steam cleaning appliance as in claim 6, wherein the at least two distinct user actions comprise applying an end-to-end force on a handle relative to the steam conduit, and applying a twisting force on the handle relative to the steam conduit.

8. A steam cleaning appliance as in claim 5, further comprising a connector that is constructed and arranged to permit rotation of the steam cleaning applicator relative to the steam conduit about an end-to-end direction of the steam applicator in either rotational direction without loosening the connection of the steam cleaning applicator to the steam conduit.

9. A steam cleaning appliance as in claim 8, wherein the connector comprises a threaded connector having: (a) an external thread portion positioned on either the steam cleaning applicator or the steam conduit, and (b) an internal thread portion positioned on the other of the steam applicator and the steam conduit.

10. A steam cleaning appliance as in claim 9, wherein:

the external thread portion is selectively rotatable relative to whichever of the steam cleaning applicator and the steam conduit that the external thread portion is positioned on, and/or the internal thread portion is selectively rotatable relative to whichever of the steam cleaning applicator and the steam conduit that the internal thread portion is positioned on.

11. A steam cleaning appliance as in claim 10, wherein when a user applies at least a threshold force in an end-to-end direction of a handle of the steam applicator, the selectively rotatable thread portion(s) is prevented from rotating more than 180 degrees in either rotational direction relative to whichever of the steam applicator and the steam conduit that the selectively rotatable thread portion(s) is positioned on, as long as the user continues to apply the at least a threshold force.

12. A steam cleaning appliance as in claim 11, wherein when the at least a threshold force is applied, the at least a threshold force overcomes a force provided by a resilient element.

13. A steam cleaning appliance as in claim 12, wherein the at least a threshold force is transferred to the thread portions of the connector.

14. A steam cleaning appliance as in claim 13, wherein the resilient element comprises a coil spring, and the at least a threshold force compresses the spring such that engagement elements on the selectively rotatable thread portion(s) engage with complementary engagement elements fixed to whichever of the steam cleaning applicator and the steam conduit that the selectively rotatable thread portion(s) is positioned on.

15. A steam cleaning appliance as in claim 14, wherein the internal thread portion is selectively rotatable relative to whichever of the steam cleaning applicator and the steam conduit that the internal thread portion is positioned on.

16. A steam cleaning appliance as in claim 15, wherein the internal thread portion is positioned on the handle of the steam cleaning applicator.

17. A steam cleaning appliance as in claim 1, wherein the steam conduit comprises a flexible hose.

18. A steam cleaning appliance as in claim 1, wherein the steam cleaning applicator includes a handle that is connected to the steam conduit.

19. A steam cleaning appliance as in claim 2, wherein the handle is detachably connectable to the steam applicator.

* * * * *